US005775241A

United States Patent [19]

Morita

[11] Patent Number: 5,775,241

[45] Date of Patent: Jul. 7, 1998

[54] SEWING MACHINE

[75] Inventor: Nami Morita, Nagoya, Japan

[73] Assignee: Brother Kogyo Kabushiki Kaisha, Nagoya, Japan

[21] Appl. No.: 762,969

[22] Filed: Dec. 10, 1996

[30] Foreign Application Priority Data

Jan. 12, 1996 [JP] Japan ..... 8-004190

[51] Int. Cl.[6] ..... D05B 21/00

[52] U.S. Cl. ..... 112/102.5; 112/445; 364/470.09

[58] Field of Search ..... 112/102.5, 470.06, 112/445, 458, 454, 103; 364/470.07, 470.09

[56] References Cited

U.S. PATENT DOCUMENTS

| | | | |
|---|---|---|---|
| 4,768,450 | 9/1988 | Kato et al. | 112/102.5 |
| 4,860,678 | 8/1989 | Skogward | 112/445 X |
| 5,228,403 | 7/1993 | Sugimoto | 112/102.5 X |
| 5,553,559 | 9/1996 | Inoue et al. | 112/102.5 |

FOREIGN PATENT DOCUMENTS

A-4-364887 12/1992 Japan .

*Primary Examiner*—Peter Nerbun
*Attorney, Agent, or Firm*—Oliff, Berridge, PLC

[57] ABSTRACT

In a sewing machine, embroidery patterns are displayed on a display on the basis of embroidery pattern data representing embroidery patterns, and an embroidery pattern is selected from among those displayed on the display. A needle and a workpiece are moved relative to each other according to an operation for setting a position for the selected embroidery pattern when only the selected embroidery pattern is positioned. When a plurality of embroidery patterns are selected, the relative movement of the needle and the workpiece is withheld during an operation for setting positions for the plurality of selected embroidery patterns. Thus, the needle and the workpiece held by an embroidery frame are not moved during operation for arranging the plurality of selected embroidery patterns.

18 Claims, 11 Drawing Sheets

SEWING MACHINE

BACKGROUND OF THE INVENTION

1. Field of the Invention

The invention relates to a sewing machine capable of processing a stitch pattern data and of stitching a pattern represented by the stitch pattern data on a workpiece.

2. Description of Related Art

There has been proposed for use in the field of, for example, industrial sewing machines, a stitch pattern data processing apparatus provided with a microcomputer and capable of quickly producing highly accurate embroidery pattern data. The stitch pattern data processing apparatus is constructed, for example, by connecting an image scanner, a keyboard, a mouse, a hard disk drive, a CRT display and such to a general-purpose personal computer system. This stitch pattern data processing apparatus is capable of producing embroidering data representing a multicolor embroidery pattern from an optional original embroidery pattern.

Generally, a sewing machine provided with such a stitch pattern data processing apparatus for processing stitch pattern data selects an optional embroidery pattern from a plurality of embroidery patterns displayed on a liquid crystal display, and sets a position at which the selected embroidery pattern is to be stitched in a predetermined embroidering area. Embroidery pattern data representing the selected embroidery pattern is read from an internal ROM or an external storage device, the embroidery pattern data is modified according to position setting conditions, and an embroidery frame holding the workpiece to be embroidered is moved relative to the needle of the sewing machine according to the modified embroidery pattern data to embroider the selected embroidery pattern at the set position on the workpiece.

Only a single embroidery pattern is selected in some cases and a plurality of embroidery patterns are selected in other cases. A position at which only one embroidery pattern is to be formed is set by one position setting cycle in the former cases and hence the embroidery frame can be moved to a desired position by one embroidery frame moving cycle.

SUMMARY OF THE INVENTION

An object of the invention is to provide a sewing machine which does not move a needle and a workpiece held on an embroidery frame relative to each other when setting a position at which an embroidery pattern is to be formed in a predetermined area.

According to a first aspect of the invention, a sewing machine which moves a needle and a workpiece relative to each other for a sewing operation comprises a first display means for displaying stitch patterns on the basis of stitch pattern data representing the shapes of the stitch patterns, a stitch pattern selecting means for selecting a stitch pattern from among those displayed by the first display means, a first position setting means for setting a position at which the selected stitch pattern is to be formed, a second position setting means for setting positions at which selected component stitch patterns of a composite stitch pattern are to be formed, a position setting means selecting means for selecting the first position setting means or the second position setting means, and a movement control means for moving the needle and the workpiece relative to each other according to a position setting operation of the first position setting means for setting a position for the selected stitch pattern when the position setting means selecting means selects the first position setting means, and withholding the movement of the needle and the workpiece relative to each other during a position setting operation of the second position setting means when the position setting means selecting means selects the second position setting means.

In this sewing machine which moves the needle and the workpiece relative to each other for a sewing operation, the first display means displays stitch patterns on the basis of stitch pattern data representing the shapes of the stitch patterns, and the stitch pattern selecting means selects a stitch pattern from among those displayed by the first display means. The first position setting means sets a position at which the selected stitch pattern is to be formed, and the second position setting means sets positions at which selected component stitch patterns of a composite stitch pattern are to be formed, respectively. The position setting means selecting means selects the first position setting means or the second position setting means.

When the first position setting means is selected, the movement control means moves the needle and the workpiece relative to each other according to a position setting operation of the first position setting means for setting a position for the stitch pattern. When the second position setting means is selected by the position setting means selecting means, the movement control means withholds the movement of the needle and the workpiece relative to each other during a position setting operation of the second position setting means. The term, stitch pattern, is a comprehensive term signifying patterns including a buttonhole stitch pattern, a pocket stitch pattern and the like.

In the sewing machine according to the first aspect of the invention, the needle and the workpiece are moved relative to each other according to a position setting operation of the first position setting operation for setting a position for the selected stitch pattern when the first position setting means is selected, and the relative movement of the needle and the workpiece is withheld during a position setting operation for setting positions respectively for the selected component stitch patterns of a composite stitch pattern. Therefore, the embroidery frame is moved according to the condition of disposition of the selected embroidery pattern when positioning the selected stitch pattern and hence the stitching operation can immediately be started. The embroidery frame is not moved until a positioning operation is completed when positions for the selected component embroidery patterns are set. Therefore, power necessary for moving the workpiece can be saved, noise which may be generated when the workpiece is moved can be reduced, and the reduction of the life of a horizontal moving mechanism due to unnecessary movement of the embroidery frame can be prevented.

According to the first aspect of the invention, it is preferable that the sewing machine further comprises a second display means for displaying a stitch pattern according to a position setting operation of the first position setting means for setting a position for the stitch pattern when the first position setting means is selected by the position setting means selecting means, and displaying component stitch patterns during a position setting operation of the second position setting means for setting positions for the selected component stitch patterns when the second position setting means is selected by the position setting means selecting means.

In this sewing machine, the second display means displays a stitch pattern according to a position setting operation of the first position setting means for setting a position for selected stitch pattern when the first position setting means is selected by the position setting means selecting means, and displays component stitch patterns during a position setting operation of the second position setting means for setting positions for the selected component stitch patterns when the second position setting means is selected by the position setting means selecting means.

Therefore, the stitch pattern is displayed according to a position setting operation of the first position setting means for setting a position for the stitch pattern when the selected stitch pattern is to be positioned, and the component stitch patterns are displayed according to a position setting operation of the second position setting means for setting positions for the selected component stitch patterns when the selected component stitch patterns are to be positioned individually. Therefore, the edited condition of the stitch pattern can be visually recognizable irrespective of the relative movement of the needle and the workpiece.

According to the first aspect of the invention, it is preferable that the sewing machine further comprises a notifying means for notifying the operator of the relative movement of the needle and the workpiece before the needle and the workpiece are moved relative to each other when the first position setting means is selected by the position setting means selecting means.

In the sewing machine, when the first position setting means is selected by the position setting means selecting means, the notifying means notifies the operator of the relative movement of the needle and the workpiece before the relative movement of the needle and the workpiece is started.

Therefore, when the selected stitch pattern is positioned uniformly, the operator is notified of the relative movement of the needle and the workpiece before the relative movement of the needle and the workpiece is started and hence the relative movement of the needle and the workpiece is visually recognizable.

According to the first aspect of the invention it is preferable that the sewing machine further comprises a needle/workpiece selectively moving means for selectively moving the needle or the workpiece during a position setting operation of the second position setting means for setting positions for the selected component stitch patterns when the second position setting means is selected by the position setting means selecting means.

When the second position setting means is selected by the position setting means selecting means, the needle or the workpiece is moved selectively during a position setting operation of the second position setting means for setting positions for the stitch patterns.

Since the sewing machine is provided with the needle/workpiece selectively moving means for moving the needle or the workpiece selectively during a position setting operation in which positions for the selected stitch patterns are set and the relative movement of the needle and the workpiece is withheld, the operator is able to move the needle to positions at which the selected component stitch patterns are to be formed if the operator desires, and hence a stitching position can accurately be confirmed.

According to a second aspect of the invention, a sewing machine which moves a needle and a workpiece relative to each other for a sewing operation comprises a first display means for displaying stitch patterns according to stitch data representing the shapes of the stitch patterns, a stitch pattern selecting means for selecting a stitch pattern from among those displayed by the first display means, a first editing means for editing stitch data representing the selected stitch pattern, a second editing means for editing stitch data representing a plurality of component stitch patterns of a composite stitch pattern, an editing means selecting means for selecting the first editing means or the second editing means, and a movement control means for moving the needle and the workpiece relative to each other according to a stitch data editing operation of the first editing means for editing stitch data on the selected stitch pattern when the first editing means is selected by the editing means selecting means, and withholding the movement of the needle and the workpiece relative to each other during a stitch data editing operation of the second editing means when the second editing means is selected by the editing means selecting means.

In the sewing machine which moves the needle and the workpiece relative to each other for a sewing operation, the first display means displays stitch patterns on the basis of data representing the shapes of the stitch patterns, and the selecting means selects a stitch pattern from among those displayed by the first display means. The first editing means edits the stitch pattern data representing the selected stitch pattern, and the second editing means edits the data representing the selected component stitch patterns of the composite stitch pattern. The editing means selecting means selects the first editing means or the second editing means. When the first editing means is selected by the editing means selecting means, the movement control means moves the needle and the workpiece relative to each other according to a stitch data editing operation of the first editing means for editing stitch data of the selected stitch pattern. When the second editing means is selected by the editing means selecting means, the movement control means withholds the relative movement of the needle and the workpiece during a stitch data editing operation of the second editing means for editing stitch data on the component stitch patterns. The term "stitch pattern" is a comprehensive term signifying patterns including a buttonhole stitch pattern and a pocket stitch pattern.

According to the second aspect of the invention, it is preferable that the sewing machine further comprise a second display means for displaying a stitch pattern according to edited stitch pattern data of the selected stitch pattern provided by the first editing means when the first editing means is selected by the editing means selecting means, and displaying the component stitch patterns according to the edited stitch pattern data on the selected component stitch patterns provided by the second editing means when the second editing means is selected by the editing means selecting means.

In this sewing machine, the second display means displays a stitch pattern according to the edited data on the selected stitch pattern provided by the first editing means when the first editing means is selected by the editing means selecting means, and displays component stitch patterns according to the edited stitch pattern data on the selected component stitch patterns provided by the second editing means when the second editing means is selected by the editing means selecting means.

According to the second aspect of the invention, it is preferable that the sewing machine further comprise a notifying means for notifying the operator of the relative movement of the needle and the workpiece before the needle and the workpiece are moved relative to each other when the first editing means is selected by the editing means selecting means.

In the sewing machine, the notifying means notifies the operator of the relative movement of the needle and the workpiece before the needle and the workpiece move relative to each other when the first editing means is selected by the editing means selecting means.

According to the second aspect of the invention, it is preferable that the sewing machine further comprise a needle/workpiece selectively moving means for selectively moving the needle or the workpiece during the editing operation of the second editing means when the second editing means is selected by the editing means selecting means.

In this sewing machine, the needle or the workpiece is moved selectively during the editing operation of the second editing means for editing when the second editing means is selected by the editing means selecting means.

BRIEF DESCRIPTION OF THE DRAWINGS

A preferred embodiment of the invention will be described in detail with reference to the accompanying drawings, wherein.

DETAILED DESCRIPTION OF THE PREFERRED EMBODIMENT

A preferred embodiment of the invention will be described hereinafter with reference to the accompanying drawings. The invention will be described as applied to a household embroidering machine.

First, the embroidering system will be described. In a practical embroidering operation, embroidery data is produced by an embroidery data processing circuit, and then an embroidering machine carries out a sewing operation to stitch the desired pattern on the basis of the embroidery data.

Figure 1:
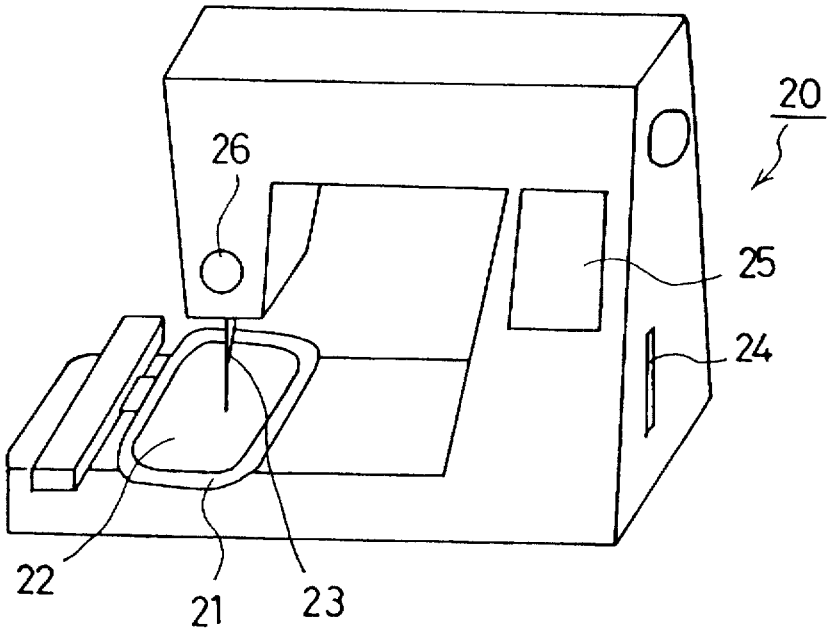
FIG. 1 is a perspective view of a household embroidering machine in a preferred embodiment according to the invention.
Figure 2:
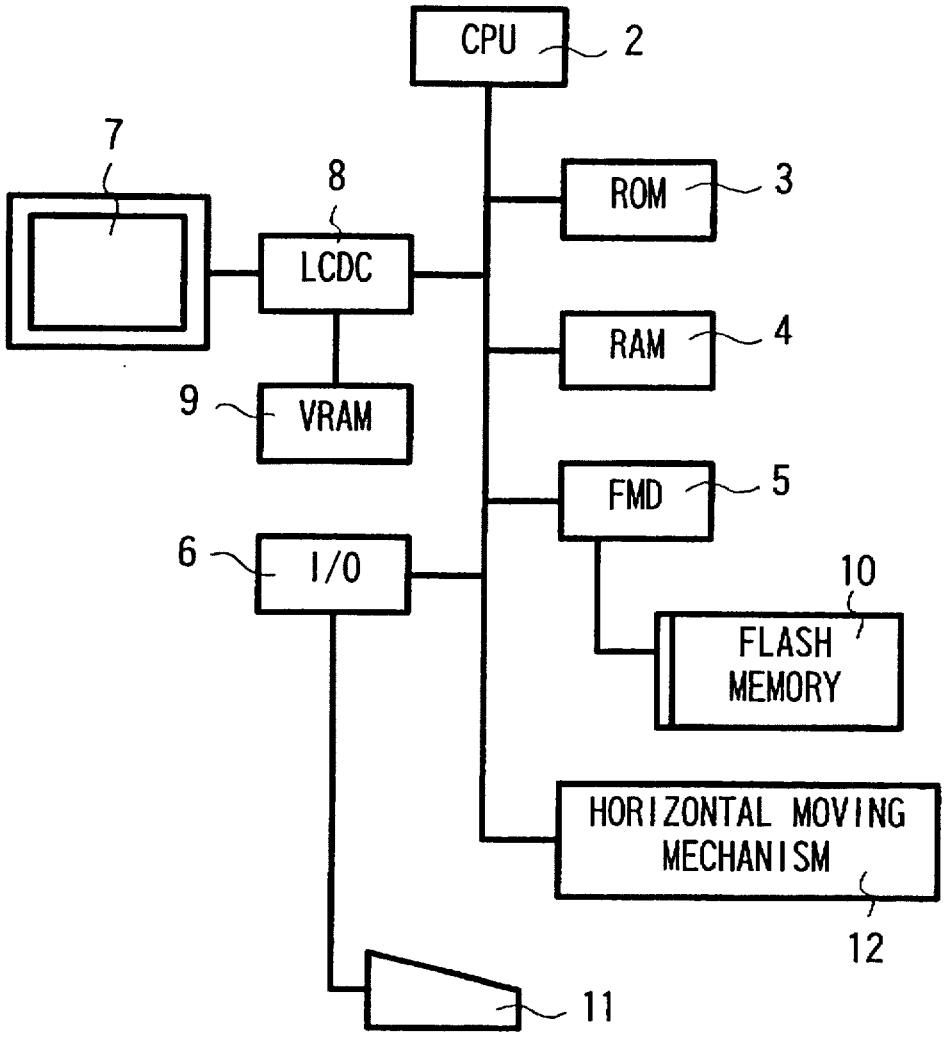
FIG. 2 is a block diagram of an embroidery data processing unit included in the embroidering machine of FIG. 1.

Referring to FIGS. 1 and 2, an embroidering machine 20 is set on a machine bed. A needle 23 executes the sewing operation while an embroidery frame 21 holding a workpiece 22 is moved to desired positions in an X–Y coordinate system, defined by an X-axis and a Y-axis, by a horizontal moving mechanism 12 (FIG. 2) to embroider a predetermined pattern on the workpiece 22. The embroidering machine 20 is provided with a flash memory device (FMD) 5 for reading data from a flash memory 10, i.e., an external storage device, a liquid crystal display 7 with a liquid crystal display panel 25 with touch panel, an embroidery data processing circuit and a controller. When the flash memory 10 is inserted in the flash memory device 5 through a slot 24 formed in the embroidering machine 20, the flash memory device 5 reads embroidery data from the flash memory 10. The embroidery data includes coordinate data representing the coordinates of needle locations in the X–Y coordinate system. The embroidery data is edited by using the touch panel, and the edited embroidery data is displayed on the liquid crystal display (LCD) 7 having the liquid crystal display panel 25. The controller, comprising a microcomputer, controls the horizontal moving mechanism 12 on the basis of the embroidery data edited by the embroidery data processing circuit to move the embroidery frame 21, and the needle 23 embroiders a pattern on the workpiece 22.

Although the embroidering machine 20 displays the edited embroidery data, the embroidery data processing circuit of the invention is applicable to sewing machines which use an internal ROM or an external ROM storing display data and embroidery data (data representing needle locations), sewing machines which produce embroidery data from display data, and sewing machines which produce display data and embroidery data from common data.

The embroidery data processing circuit will be described with reference to FIG. 2.

The embroidery data processing circuit comprises a CPU 2 which executes various procedures for embroidery data processing, a ROM 3 storing control programs and data, and a RAM 4 for storing various data including image data representing graphic forms for forming embroidery patterns and an embroidering region corresponding to the embroidery frame 21. The CPU 2 executes programs for accomplishing an embroidery data producing procedure, stored in the ROM 3 or an external storage device.

The embroidery data processing circuit is provided with the flash memory device 5, an interface 6 and an input unit 11. The flash memory 10 is inserted into the flash memory device 5. The produced or used embroidery data is obtained from what is stored in the flash memory 10. The input unit 11 includes the touch panel provided on the liquid crystal display panel 25 disposed on the embroidery machine 20. Instructions for pattern selection and pattern arrangement are given by using the touch panel. Instructions entered by operating the touch panel are transferred through the interface 6 to the CPU 2 and the RAM 4.

The embroidery data processing circuit further includes the liquid crystal display 7 having the liquid crystal display panel 25 for displaying image data representing embroidery patterns and an embroidering region, and a liquid crystal display controller (LCDC) 8 for controlling the liquid crystal display 7. An image storage device (VRAM) 9 is connected to the liquid crystal display controller 8 to enable a monochromatic bit map graphics display. The horizontal moving mechanism 12 for moving the embroidery frame 21 is controlled on the basis of embroidery data edited by the embroidery data processing circuit to embroider the workpiece 22. As mentioned in Japanese Unexamined Patent Publication No. Hei 4-364887, the horizontal moving mechanism 12 comprises a known stepping motor, a timing belt, timing belt support members and such, and drives the embroidery frame 21 for movement.

The liquid crystal display 7 and the liquid crystal display controller 8 comprise the first and the second display means; the CPU 2, the ROM 3, the RAM 4, the interface 6 and the touch panel 11 comprise the stitch pattern selecting means, the first position setting means, the second position setting means, the first editing means, the second editing means and the selecting means; and the controller and the horizontal moving mechanism 12 comprise the movement control means.

In the flowcharts shown in FIGS. 3A, 3B and 4A, 4B, the first display means functions in steps S8 and S28, the selecting means functions in steps S10 and S30, the first position setting means and the first editing means function in step S12, the second position setting means and the second editing means function in step S36, the selecting means functions in step S3, the movement control means functions in step S54, the second display means functions in steps S42 and S52.

The operation of the stitch pattern data processing circuit of the invention will be described with reference to FIGS. 3A to 9.

Figure 3A:
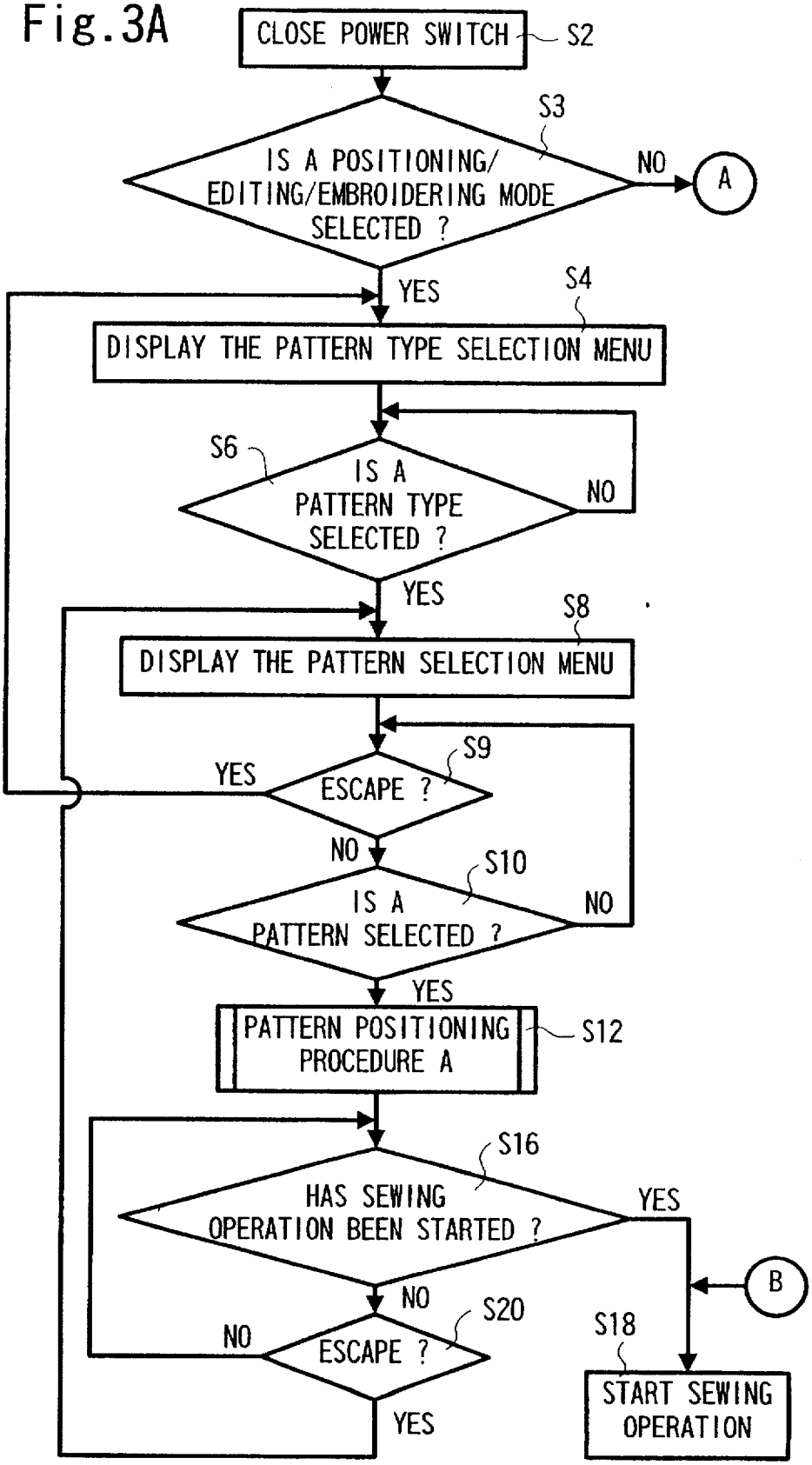
FIGS. 3A And 3B are a flowchart of an embroidery data producing process.
Figure 3B:
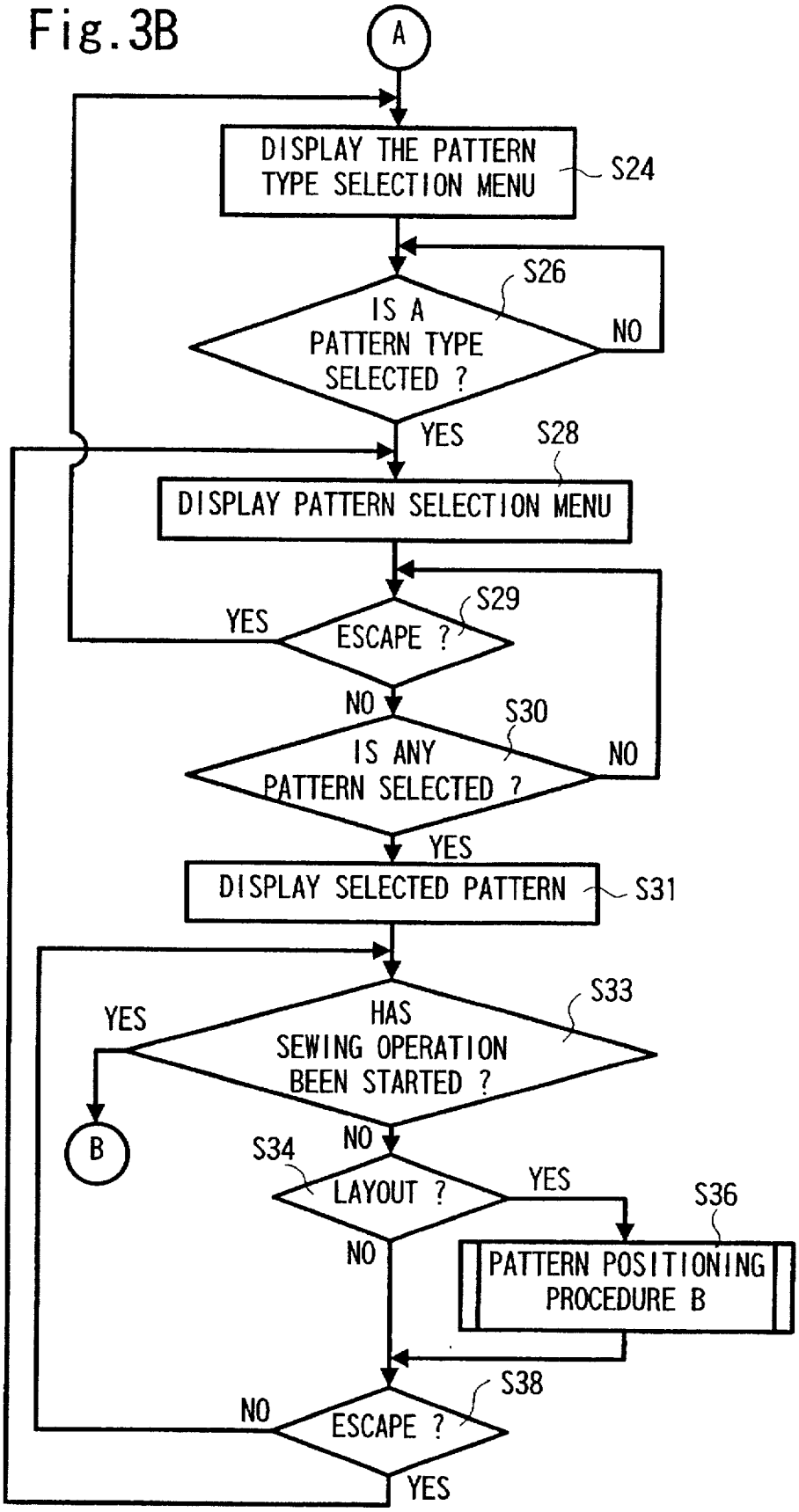
Figure 5:
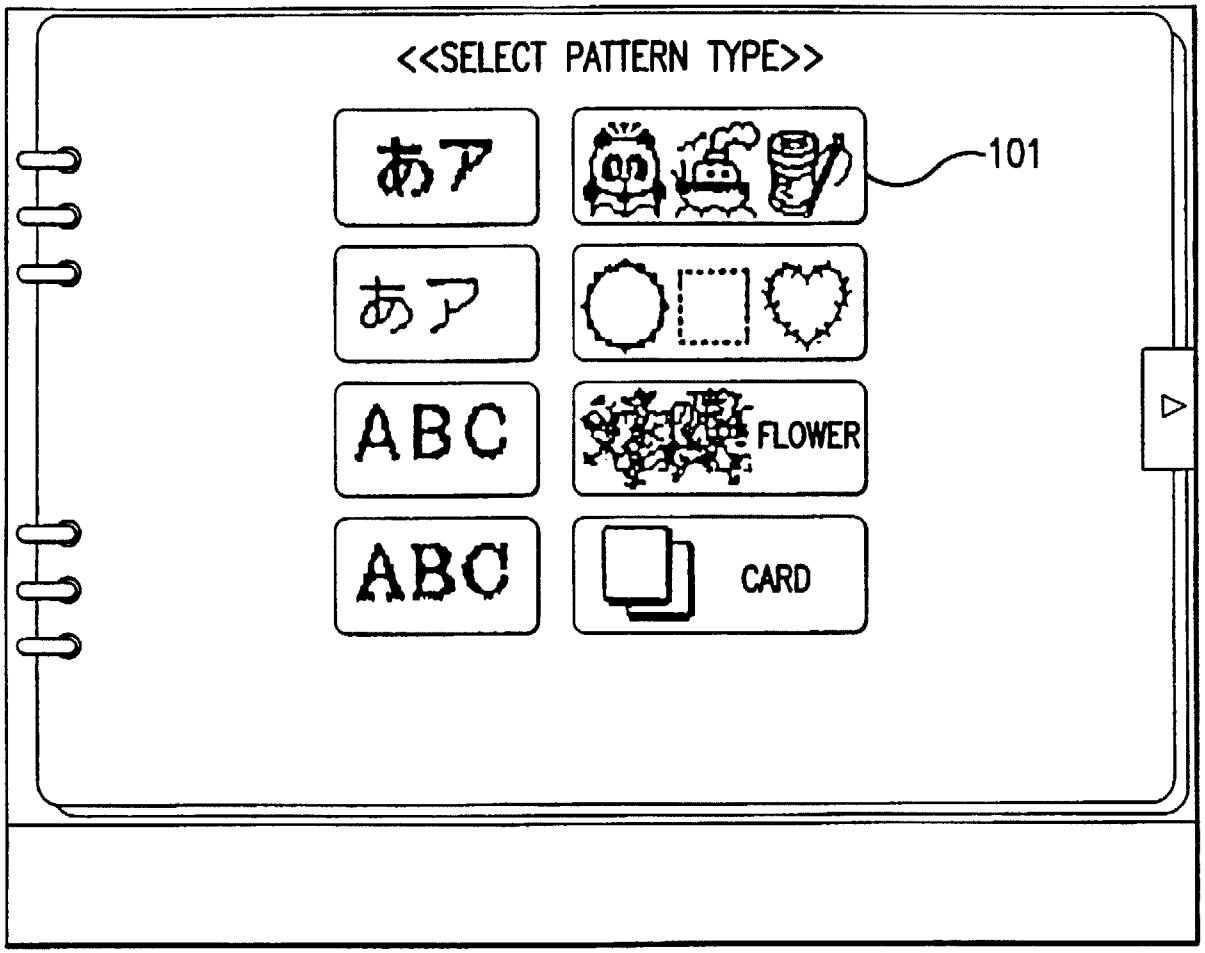
FIG. 5 is a pictorial view of a pattern type selection menu displayed on the liquid crystal display panel of a liquid crystal display.
Figure 6:
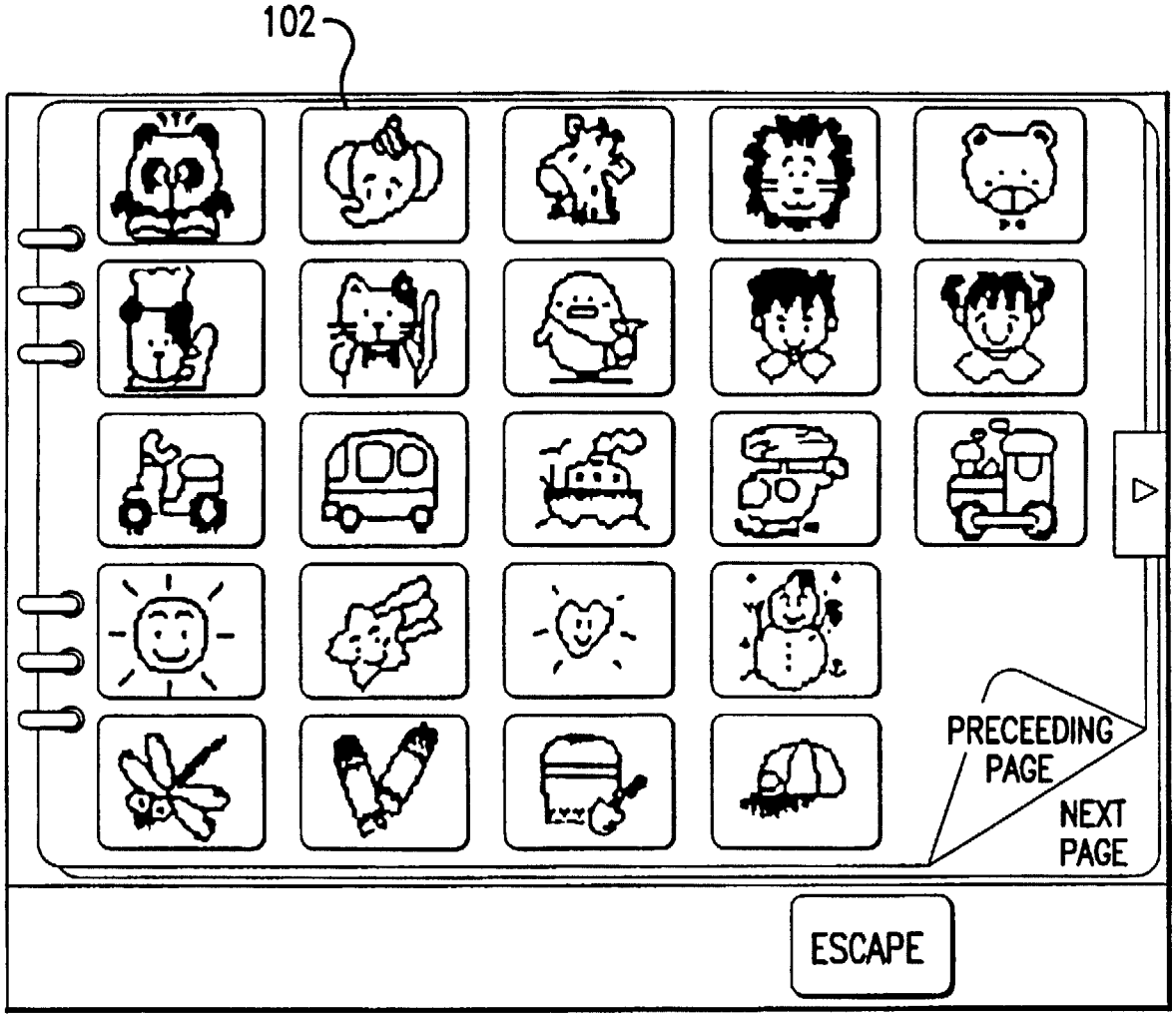
FIG. 6 is a pictorial view of a pattern selection menu displayed on the liquid crystal display panel of the liquid crystal display.
Figure 7:
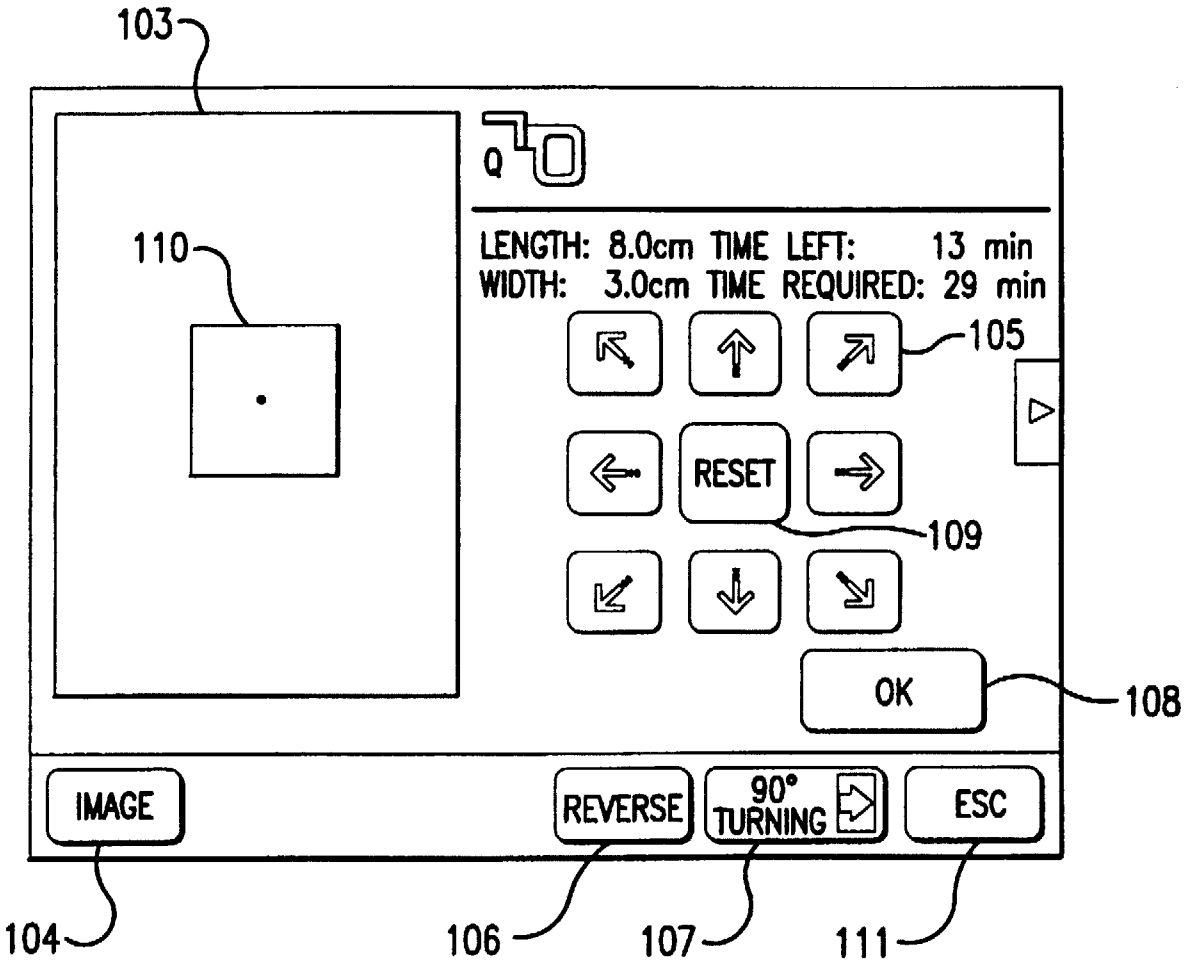
FIG. 7 is a pictorial view of a pattern layout menu displayed on the liquid crystal display panel of the liquid crystal display.
Figure 8:
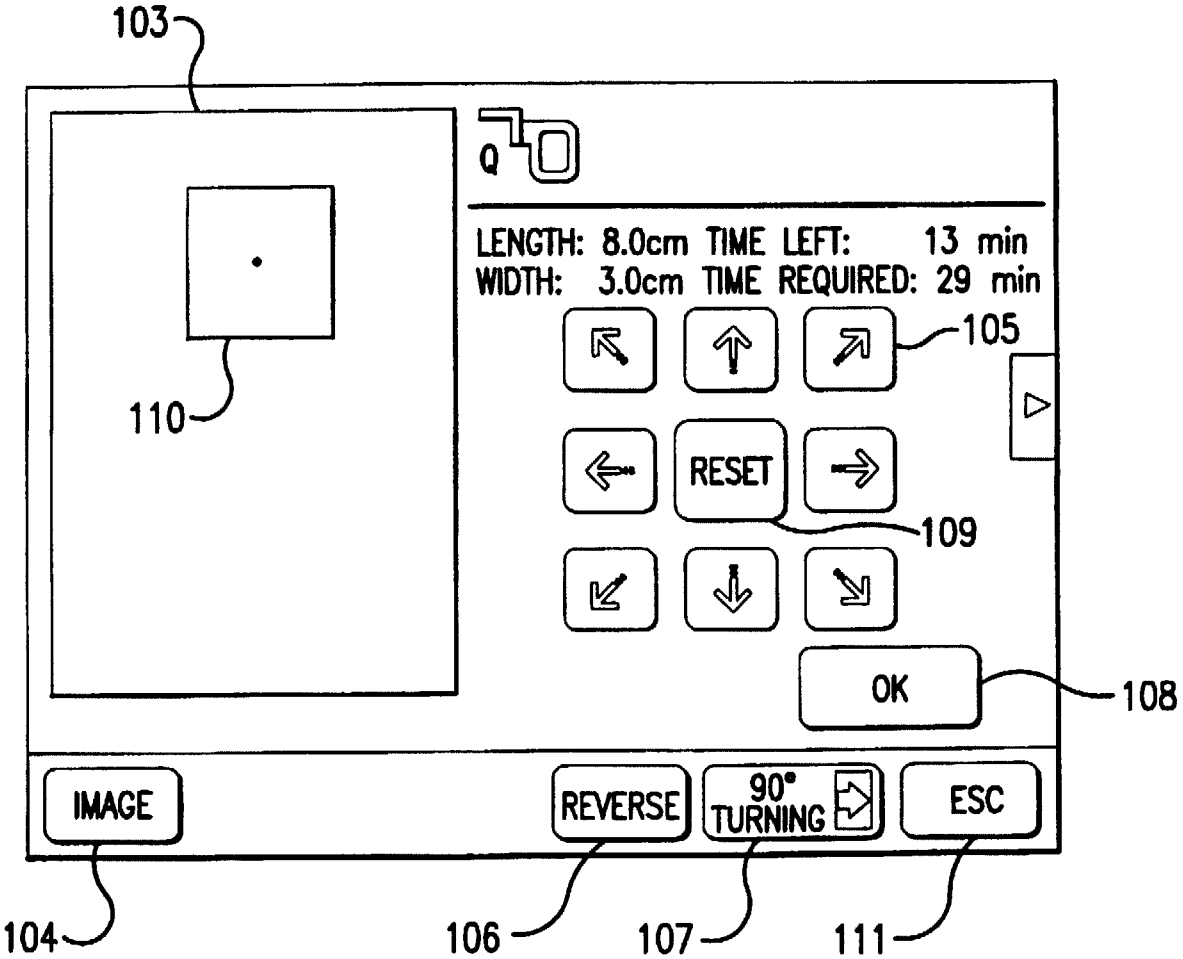
FIG. 8 is a pictorial view of a pattern layout menu displayed on the liquid crystal display panel of the liquid crystal display.
Figure 9:
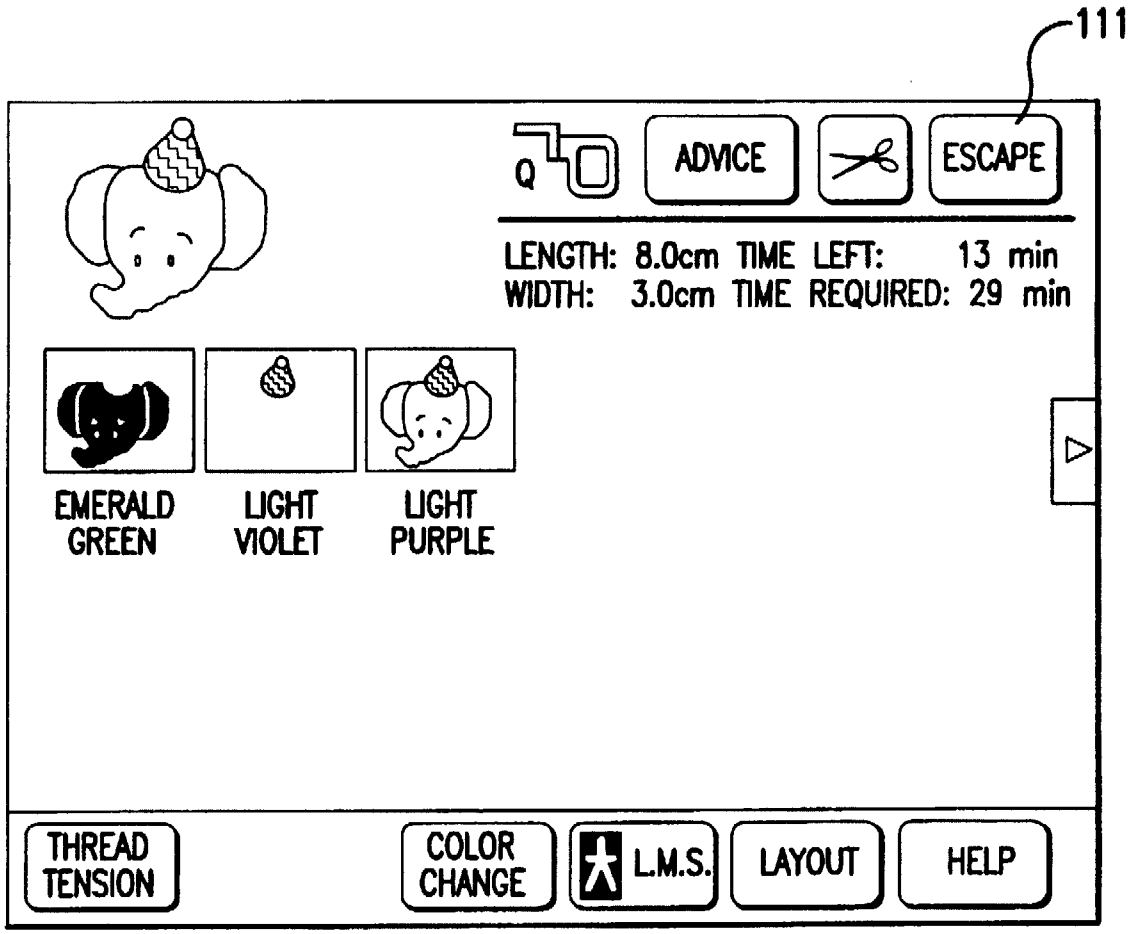
FIG. 9 is a pictorial view of selected patterns displayed on the liquid crystal display panel of the liquid crystal display.

FIGS. 3A, 3B are a flowchart showing steps of an embroidery data producing procedure. The embroidery data producing procedure will be described with reference to FIGS. 5 to 9 showing pictures displayed on the liquid crystal display panel 25. FIG. 5 shows a pattern type selection menu, by way of example; FIGS. 7 and 8 show pattern layout menus, by way of example; and FIG. 9 shows a selected pattern, by way of example, as displayed on the liquid crystal display panel 25.

Referring to FIGS. 3A, 3B, the power switch of the embroidering machine 20 is turned on in step S2 and a query is made, in step S3, to see if a positioning/editing/embroidering mode is selected. Positions of selected component embroidery patterns of a composite embroidery pattern are set individually, when the positioning/editing/embroidering mode is selected, and a single selected embroidery pattern is positioned uniformly when the positioning/editing/embroidering mode is not selected, as will be more specifically described later.

When the positioning/editing/embroidering mode is selected, i.e., when the response in step S3 is YES, the pattern type selection menu is displayed on the liquid crystal display panel 25, as shown in FIG. 5, in step S4. In step S6, the embroidery data processing circuit remains in a standby state until a pattern is selected from the patterns included in the pattern selection menu displayed on the liquid crystal display panel 25. Suppose that a pattern type 101 (FIG. 5) is selected in step S6, i.e., the response in step S6 is YES, then in step S8 the pattern selection menu, shown in FIG. 6, is displayed on the liquid crystal display panel 25.

If ESC (escape key) is pressed, i.e., when the response in step S9 is YES, the pattern selection menu (FIG. 5) is again displayed, and then steps S4 to S9 are repeated.

Figure 4A:
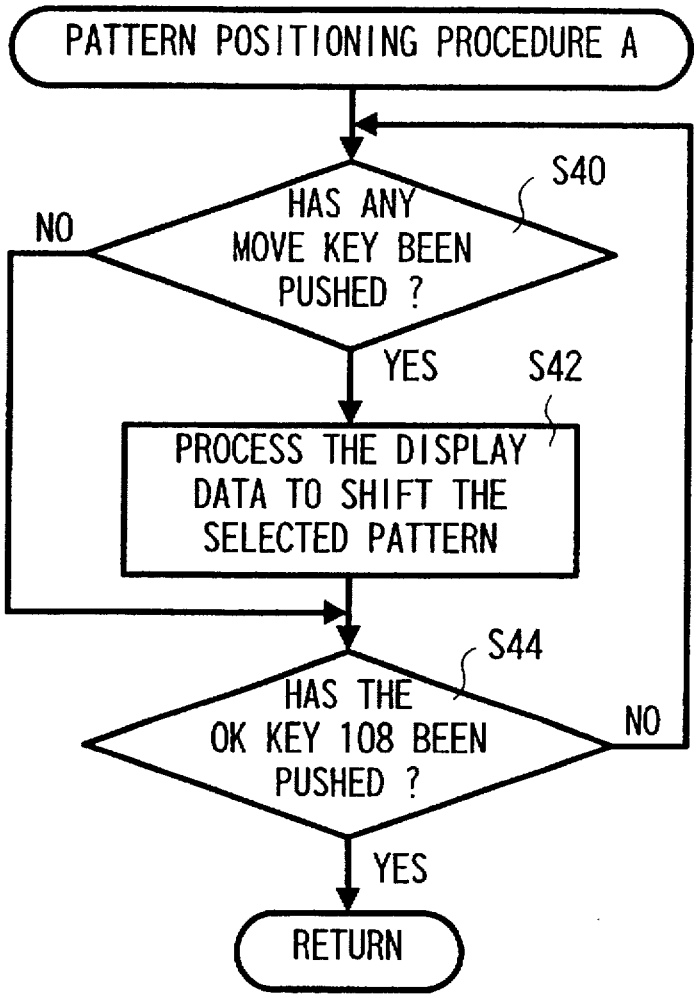
FIGS. 4A and 4B are flowcharts of pattern positioning procedures.

In step S10, an embroidery pattern among those included in the pattern selection menu is selected. Suppose that embroidery pattern 102 is selected. Then, the response in step S10 is YES and a pattern positioning procedure A, i.e., a subroutine, shown in FIG. 4A, is invoked in step S12 and a pattern layout menu, as shown in FIG. 7, is displayed on the liquid crystal display panel 25. The pattern layout menu includes an available stitching area 103, scaled to correspond to the embroidery frame 21, in which the embroidering machine 20 is able to stitch patterns, a pattern frame 110 of a size corresponding to that of the selected embroidery pattern, an image key 104, eight frame movement keys 105, a reverse key 106, a 90° turn key 107, an OK key 108, a reset key 109 and an escape key 111.

The eight move keys 105 are used to move the selected embroidery pattern, i.e., the pattern frame 110, in the direction of the arrows marked thereon within the available stitching area 103. When any one of the move keys 105 is pushed once, the pattern frame 110 moves 0.1 mm in the direction of the arrow marked on the pushed move key 105. The image key 104 is pushed to display the selected embroidery pattern after the position of the embroidery pattern has been determined. When the reverse key 106 is pushed, the selected embroidery pattern is reversed to display an mirror image pattern. The 90° turn key 107 is pushed to turn the selected embroidery pattern through 90°. When the reset key 109 is pushed, an edited embroidery pattern is reset to the original selected embroidery pattern. Functions of the OK key 108 and the escape key 111 will be described later.

The arrangement of the keys, shown in FIG. 7, is only an example. The pattern layout menu may include, for example, a turn key for turning the selected embroidery pattern, an arrangement key for changing the arrangement of embroidery patterns, a space key for changing intervals between embroidery patterns and keys for editing the embroidery pattern.

After the pattern layout menu has been displayed, the CPU 2 makes a query in step S40 to see if any move key 105 is pushed. When a move key 105 is pushed, i.e., the response in step S40 is YES, the CPU 2 processes, in step S42, the display data on the basis of the direction and the distance of movement specified by operating the move key 105. Consequently, the pattern frame 110, i.e., the selected embroidery pattern, is shifted in the available stitching area 103 as shown in FIG. 8. However, the embroidery frame 21 itself is not shifted even if the pattern frame 110 is shifted on the liquid crystal display panel 25.

When none of the move keys 105 is pushed, i.e., the response in step S40 is NO, or after the display data has been processed, a query is made to see if the OK key 108 is pushed in step S44. When the OK key 108 is not pushed, i.e., the response in step S44 is NO, steps S40 through S44 are repeated. When the OK key 108 is pushed, i.e., when the response in step S44 is YES, the pattern positioning procedure is ended and the program returns to the main routine shown in FIG. 3A. Because the embroidery frame 21 is kept stationary until the final disposition of the selected pattern is determined when positions for the selected component embroidery patterns are set, power for moving the workpiece 22 is not necessary and hence noise is not generated. Also, because the embroidery frame 21 is not moved unnecessarily, unnecessary wear of the horizontal moving mechanism 12 is prevented and, hence, the life of the horizontal moving mechanism 12 is extended.

The embroidery machine 20 may be provided with a needle/workpiece moving means for moving the needle 23 and the workpiece 22 relative to each other during the embroidery pattern positioning operation in which the relative movement of the needle 23 and the workpiece 22 is withheld, to move, when desired, the needle to a position corresponding to the position of the embroidery pattern for accurate confirmation of a stitching position.

When the escape key 111, included in the pattern layout menu is pushed, i.e., when the response in step S20 is yes, the pattern selection menu (FIG. 6) is again displayed and steps S8 through S12 are repeated to select from the plurality of embroidery patterns.

Steps S4 to S20 are repeated until a sewing operation start key 26 (FIG. 1) is pushed. When the sewing operation start key 26 is pushed with the pattern layout menu displayed on the liquid crystal display panel 25, i.e., when the response in step S16 is YES, embroidery data is produced on the basis of the edited condition of the selected embroidery pattern, the controller controls the movement of the embroidery frame 21, holding the workpiece 22 relative to the needle 23, in step S18 to embroider the selected embroidery pattern on the workpiece 22.

Operations to be carried out when the positioning/editing/embroidering mode is not selected will be described hereinafter.

If the positioning/editing/embroidering mode is not selected, i.e., if the response in step S3 is NO, the pattern type selection menu of FIG. 5 is displayed on the liquid crystal display panel 25 in step S24. Then, the embroidery data processing circuit remains in a standby state in step S26 until one of the pattern types included in the pattern type selection menu is selected. Suppose that the pattern type 101, shown in FIG. 5, is selected. Then, the response in step S26 is YES and the pattern selection menu of FIG. 6 is displayed on the liquid crystal display panel 25 in step S28.

If ESC, i.e., an escape key, is pushed, i.e., the response in step S29 is YES, the pattern type selection menu (FIG. 5) is again displayed and steps S24 through S29 are repeated.

While the pattern selection menu (FIG. 6) is displayed, one of the displayed embroidery patterns can be selected (step S30). Suppose that the embroidery pattern 102 (FIG. 6) is selected. Then, the response in step S30 is YES and the selected embroidery pattern 102 is displayed on the liquid crystal display panel 25 in step S31.

Figure 4B:
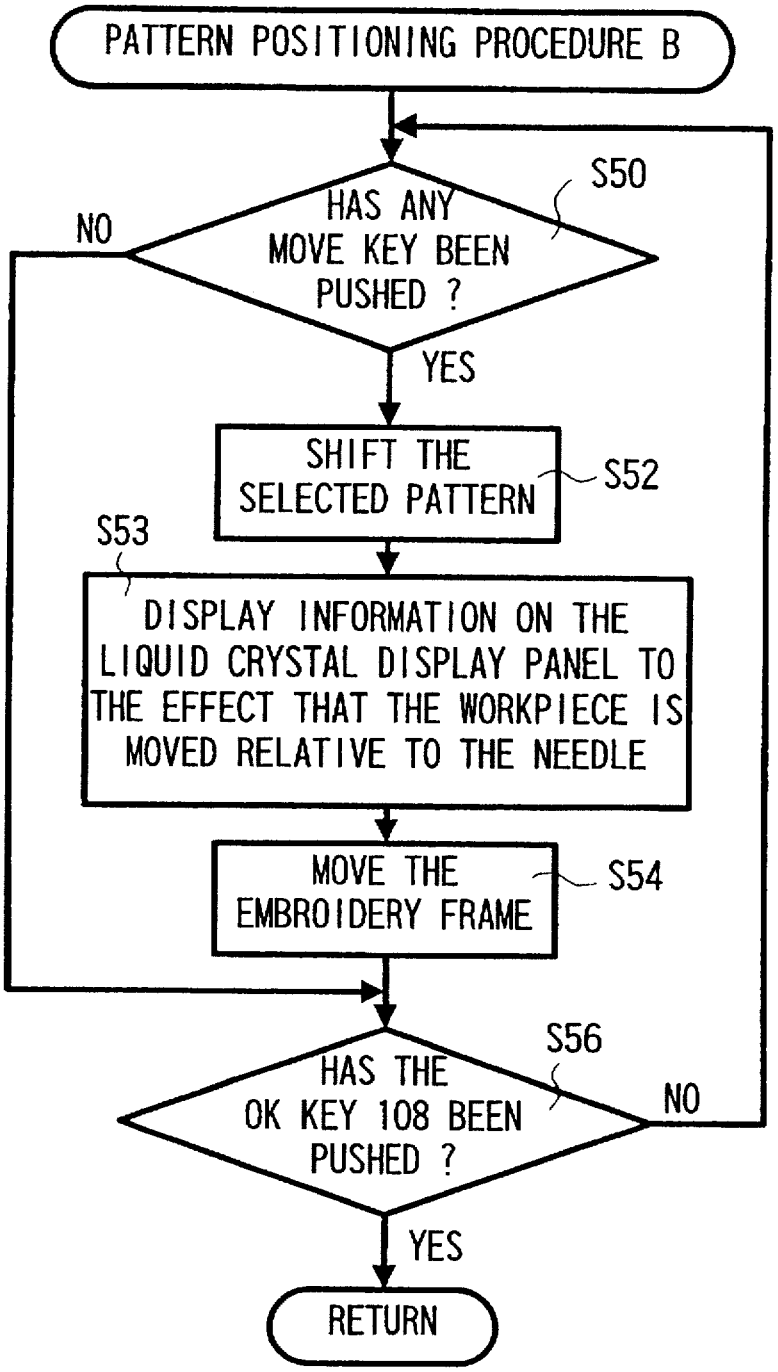

If the sewing operation start key 26 is not pushed (step S33) and the LAYOUT (layout key) is pushed, in step S34, in a state where the embroidery pattern 102 is selected as shown in FIG. 9, a pattern positioning procedure B, i.e., a subroutine shown in FIG. 4B, is invoked in step S36 and the pattern layout menu, as shown in FIG. 7, is displayed on the liquid crystal display panel 25, in which keys the same as those described above are arranged as described.

After the pattern layout menu has been displayed, the CPU 2 makes a query in step S50 to see if any move key 105 is pushed. When a move key 105 is pushed, i.e., the response in step S50 is YES, the CPU 2, in step S52, processes the display data on the basis of a direction and a distance of movement specified by the operation of the move key 105. Consequently, the pattern frame 110, i.e., the selected embroidery pattern, is shifted in the available stitching area 103 as shown in FIG. 8. Then, information is displayed on the liquid crystal display panel 25 to the effect that the workpiece 22 is moved relative to the needle 23 in step S53, the embroidery data is processed on the basis of directions and distances specified by operating the move keys 105, and then the controller controls the horizontal movement mechanism 12 on the basis of the processed embroidery data to move the embroidery frame 21 holding the workpiece 22 relative to the needle 23 in step S54.

When none of the move keys 105 is pushed, i.e., the response in step S50 is negative or after the execution of step S54 for moving the embroidery frame 22, a query is made to see if the OK key 108 is pushed in step S56. When the OK key 108 is not pushed, i.e., the response in step S56 is NO, steps S50 through S56 are repeated. When the OK key 108 is pushed, i.e., when the response in step S56 is YES, the pattern positioning procedure is ended and the program returns to the main routine shown in FIG. 3B. Thus, the embroidery frame 22 is shifted according to the disposition of the selected embroidery pattern when the single embroidery pattern is positioned, the sewing operation can be started immediately after the sewing operation start key 26 is pushed (FIG. 1).

If the escape key 111 is pushed in a state where a pattern is selected as shown in FIG. 9, i.e., the response in step S38 is YES, the pattern selection menu (FIG. 6) is displayed again, and steps S28 through S38 are repeated to select a plurality of patterns.

Steps S24 through S38 are repeated until the sewing operation start key 26 (FIG. 1) is pushed. When the sewing operation start key 26 of the embroidery machine 20 is pushed, i.e., when the response in step S33 is YES, embroidery data is produced on the basis of the condition of edition of the selected embroidery pattern, and the controller controls the movement of the embroidery frame 22 for sewing operation in step S18.

Data on the pattern type selection menu (FIG. 5) and the pattern selection menu (FIG. 6) are stored in the form of binary bit map data in the internal ROM 3 of the embroidery machine 20, or in an external storage device, such as a floppy disk or a flash memory. The binary bit map data is read according to instructions provided by the CPU 2 and displayed on the liquid crystal display panel 25.

Although the invention has been discussed in detail herein, it is not limited to the embodiment precisely as disclosed. Various changes or modifications would be apparent to one skilled in the art, such changes or modifications falling within the scope of the invention.

What is claimed is:

1. A sewing machine which moves a needle and a workpiece relative to each other for a sewing operation, the sewing machine comprising:

first display means for displaying stitch patterns on the basis of stitch pattern data representing shapes of the stitch patterns;

stitch pattern selecting means for selecting a stitch pattern from among those displayed by the first display means;

first position setting means for setting a position at which the selected stitch pattern is to be formed;

second position setting means for setting positions at which selected component stitch patterns of a composite stitch pattern are to be formed;

position setting means selecting means for selecting a one of the first position setting means and the second position setting means; and movement control means for moving the needle and the workpiece relative to each other according to a position setting operation of the first position setting means for setting the position for the selected stitch pattern when the position setting means selecting means selects the first position setting means and withholding the movement of the needle and the workpiece relative to each other during a position setting operation of the second position setting means when the position setting means selecting means selects the second position setting means.

2. The sewing machine according to claim 1, further comprising second display means for displaying a stitch pattern according to a position setting operation of the first position setting means for setting a position for the stitch pattern when the first position setting means is selected by the position setting means selecting means, and for displaying selected component stitch patterns of a composite stitch pattern according to a position setting operation for setting positions for the component stitch patterns when the second position setting means is selected by the position setting means selecting means.

3. The sewing machine according to claim 1, further comprising notifying means for notifying an operator of the relative movement of the needle and the workpiece before the needle and the workpiece move relative to each other when the first position setting means is selected by the position setting means selecting means.

4. The sewing machine according to claim 1, further comprising needle/workpiece selectively moving means for selectively moving the needle or the workpiece during the position setting operation of the second position setting means for setting positions for the selected component stitch patterns when the second position setting means is selected by the position setting means selecting means.

5. A sewing machine which moves a needle and a workpiece relative to each other for sewing operation, the sewing machine comprising:

first display means for displaying stitch patterns according to stitch data representing shapes of the stitch patterns;

stitch pattern selecting means for selecting a stitch pattern among those displayed by the first display means;

first editing means for editing stitch data representing the selected stitch pattern;

second editing means for editing stitch data representing a plurality of component stitch patterns of a composite stitch pattern;

editing means selecting means for selecting a one of the first editing means and the second editing means; and movement control means for moving the needle and the workpiece relative to each other according to a stitch data editing operation of the first editing means for editing data on the selected stitch pattern when the first editing means is selected by the editing means selecting means and withholding the movement of the needle and the workpiece relative to each other during a stitch data editing operation of the second editing means for editing stitch data on the component stitch patterns when the second editing means is selected by the editing means selecting means.

6. The sewing machine according to claim 5, further comprising second display means for displaying a stitch pattern according to a stitch pattern data editing operation of the first editing means for editing stitch pattern data on the selected stitch pattern when the first editing means is selected by the editing means selecting means, and displaying the component stitch patterns during a stitch pattern editing operation of the second editing means for editing stitch pattern data on the selected component stitch patterns when the second editing means is selected by the editing means selecting means.

7. The sewing machine according to claim 5, further comprising notifying means for notifying the operator of the relative movement of the needle and the workpiece before the needle and the workpiece are moved relative to each other when the first editing means is selected by the editing means selecting means.

8. The sewing machine according to claim 5, further comprising needle/workpiece selectively moving means for selectively moving the needle or the workpiece during the editing operation of the second editing means when the second editing means is selected by the editing means selecting means.

9. A sewing machine for sewing selected patterns on a piece of material, the sewing machine having a material frame holding the piece of material and at least one needle, further comprising:

means for moving the material frame and the at least one needle relative to one another;

means for selecting a pattern from a plurality of patterns;

means for positioning the selected pattern relative to and within boundaries of the material frame;

means for selecting one of real time relative movement of the material frame and the at least one needle and virtual movement of the material frame and the at least one needle, and a display for showing a position of the selected pattern relative to the boundaries of the material frame, wherein when real time relative movement of the material frame and the at least one needle is selected using the means for selecting, the material frame and the at least one needle are moved relative to one another simultaneously with the position displayed and when virtual movement of the material frame and the at least one needle is selected using the means for selecting, the material frame and the at least one needle are not moved relative to one another when the position displayed is moved.

10. The sewing machine according to claim 9, wherein when real time movement is selected, the means for moving moves the material frame in coordination with the means for positioning the selected pattern as shown on the display.

11. The sewing machine according to claim 9, further comprising actuating means for actuating the means for positioning when virtual movement has been selected, the actuating means being activated after positioning of the selected pattern is completed.

12. The sewing machine according to claim 10, further comprising a begin sewing switch to start sewing after the means for moving has positioned the material frame and the at least one needle relative to one another.

13. The sewing machine according to claim 12, further comprising escape means for reactivating the means for selecting the pattern.

14. The sewing machine according to claim 9, wherein the means for positioning comprises a plurality of switches, each switch designating a direction of movement in a plane.

15. The sewing machine according to claim 9, wherein the display is on a body of the sewing machine.

16. The sewing machine according to claim 9, wherein the display further comprises a touch panel.

17. The sewing machine according to claim 16, wherein the display displays at least one stitch pattern and at least one switch.

18. The sewing machine according to claim 16, wherein the display displays at least one stitch pattern, at least one switch, and a representation of the material frame.

* * * * *